US006811177B2

(12) United States Patent
Lancon et al.

(10) Patent No.: US 6,811,177 B2
(45) Date of Patent: Nov. 2, 2004

(54) BINDING FOR A CROSS-COUNTRY SKI

(75) Inventors: Bruno Lancon, Villy le Pelloux (FR); Eddy Yelovina, Synod (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/335,917

(22) Filed: Jan. 3, 2003

(65) Prior Publication Data

US 2003/0127833 A1 Jul. 10, 2003

(30) Foreign Application Priority Data

Jan. 4, 2002 (FR) ..... 02 00225

(51) Int. Cl.[7] ..... A63C 9/00; A63C 9/08
(52) U.S. Cl. ..... 280/615; 280/611; 280/613
(58) Field of Search ..... 280/611, 614, 280/615, 617, 618, 624, 625, 623, 634, 613, 633

(56) References Cited

U.S. PATENT DOCUMENTS

| | | | | | |
|---|---|---|---|---|---|
| 3,396,479 | A | * | 8/1968 | Primak | 36/99 |
| 4,836,572 | A | * | 6/1989 | Pozzobon | 280/613 |
| 4,915,406 | A | * | 4/1990 | Graillat | 280/615 |
| 4,995,632 | A | | 2/1991 | Girault et al. | 280/615 |
| 5,048,855 | A | | 9/1991 | Girault et al. | 280/615 |
| 5,052,709 | A | | 10/1991 | Girault et al. | 280/615 |
| 5,085,454 | A | * | 2/1992 | Provence et al. | 280/615 |
| 5,190,309 | A | * | 3/1993 | Spitaler et al. | 280/615 |
| 5,924,719 | A | * | 7/1999 | Girard | 280/615 |
| 5,938,228 | A | * | 8/1999 | Bourdeau | 280/607 |
| 6,182,999 | B1 | | 2/2001 | Bourdeau | 280/607 |
| 6,402,184 | B1 | * | 6/2002 | Hauglin | 280/615 |

FOREIGN PATENT DOCUMENTS

| | | | |
|---|---|---|---|
| FR | 2578168 | 9/1986 | |
| FR | 2645758 | 10/1990 | |
| FR | 2645759 | 10/1990 | |
| FR | 2645760 | 10/1990 | |
| FR | 2645761 | 10/1990 | |
| WO | WO 94/09660 | * 11/1994 | 280/615 |

* cited by examiner

*Primary Examiner*—Christopher P. Ellis
*Assistant Examiner*—G B Klebe
(74) *Attorney, Agent, or Firm*—Greenblum & Bernstein, P.L.C.

(57) ABSTRACT

A device for binding a boot to a sports article, of the type having a housing that is adapted to receive a member for fastening the boot, and which is provided with a movable latch capable of being displaced between an open position, in which the fastening member can be introduced or disengaged from the housing, and a closed position, in which the latch prevents the disengagement of the fastening member, and of the type in which the displacement of the latch is controlled by a control system, whereby the control system has a gripping member that is slidably movable, and a connecting rod that is linked by its two ends to the latch, on the one hand, and to the gripping member, on the other hand.

30 Claims, 4 Drawing Sheets

BINDING FOR A CROSS-COUNTRY SKI

CROSS-REFERENCE TO RELATED APPLICATION

This application is based upon French Patent Application No. 02.00225, filed Jan. 4, 2002, the priority of which is hereby claimed under 35 U.S.C. §119.

BACKGROUND OF THE INVENTION

1. Field of the Invention

The present invention relates to a device for binding a boot to a sports article. It is used more particularly in devices in which the boot is attached to the sports article by its front portion, but in which the heel remains free to be raised with respect to the sports article. This type of binding device is used, for example, in cross-country skiing.

2. Description of Background and Relevant Information

The invention will be described more particularly in its application to a binding device of the type described, for example, in documents FR 2 645 758, FR 2 645 759, FR 2 645 760, and FR 2 645 761, documents to which reference will be made advantageously for a detailed description of these devices. The invention will also be described as it relates to cross-country ski binding devices, or systems, such as those marketed by the assignee of the instant application and commercially known as "SNS Profil" and "SNS Pilot."

In the aforementioned systems, the boot has a fastening member, for example, a transverse rod, and the binding device has a housing in which the fastening member can be received, the housing being open or closed depending on the position of a latch. Indeed, the latch is displaced between an open position in which the fastening member can be introduced or disengaged from the housing, and a closed position in which the latch prevents the disengagement of the fastening member. This displacement is, for example, a longitudinal sliding. The passage from the open position to the closed position occurs, in the example that will be described hereinbelow, along a forward movement of the latch, but one can provide for this movement to be a rearward movement of the latch (relative to a front/rear direction of the sports article on which the binding device is mounted).

In currently known devices, the displacement of the latch between its open and closed positions is controlled by a control system that generally uses a lever articulated about a transverse axis. If need be, the control system can have a knuckle joint mechanism, i.e., an over-center mechanism, inserted between the control lever and the latch to guarantee the locking of the latch in the closed position. Such a relatively sophisticated control system functions perfectly well, but it has the drawback of being relatively expensive to manufacture. When the binding device is adapted for a use in which the forces imposed on the device are weak, for example, for bindings adapted specifically for children, such a construction can prove to be too expensive compared to the performances required.

SUMMARY OF THE INVENTION

The invention proposes a binding device that is particularly simple in terms of manufacture, and therefore of costs, as well as in terms of use.

To this end, the invention proposes a device for binding a boot to a sports article, of the type having a housing that is adapted to receive a member for fastening the boot, and which is provided with a movable latch capable of being displaced between an open position, in which the fastening member can be introduced or disengaged from the housing, and a closed position in which the latch prevents the disengagement of the fastening member, and of the type in which the displacement of the latch is controlled by a control system, and in which the control system has a gripping member that is slidably movable, and a connecting rod that is linked by its two ends to the latch, on the one hand, and to the gripping member, on the other hand.

BRIEF DESCRIPTION OF DRAWINGS

Other features and advantages of the invention will become apparent from reading the following detailed description, with reference to the attached drawings, in which.

DETAILED DESCRIPTION OF THE INVENTION

Figure 1:
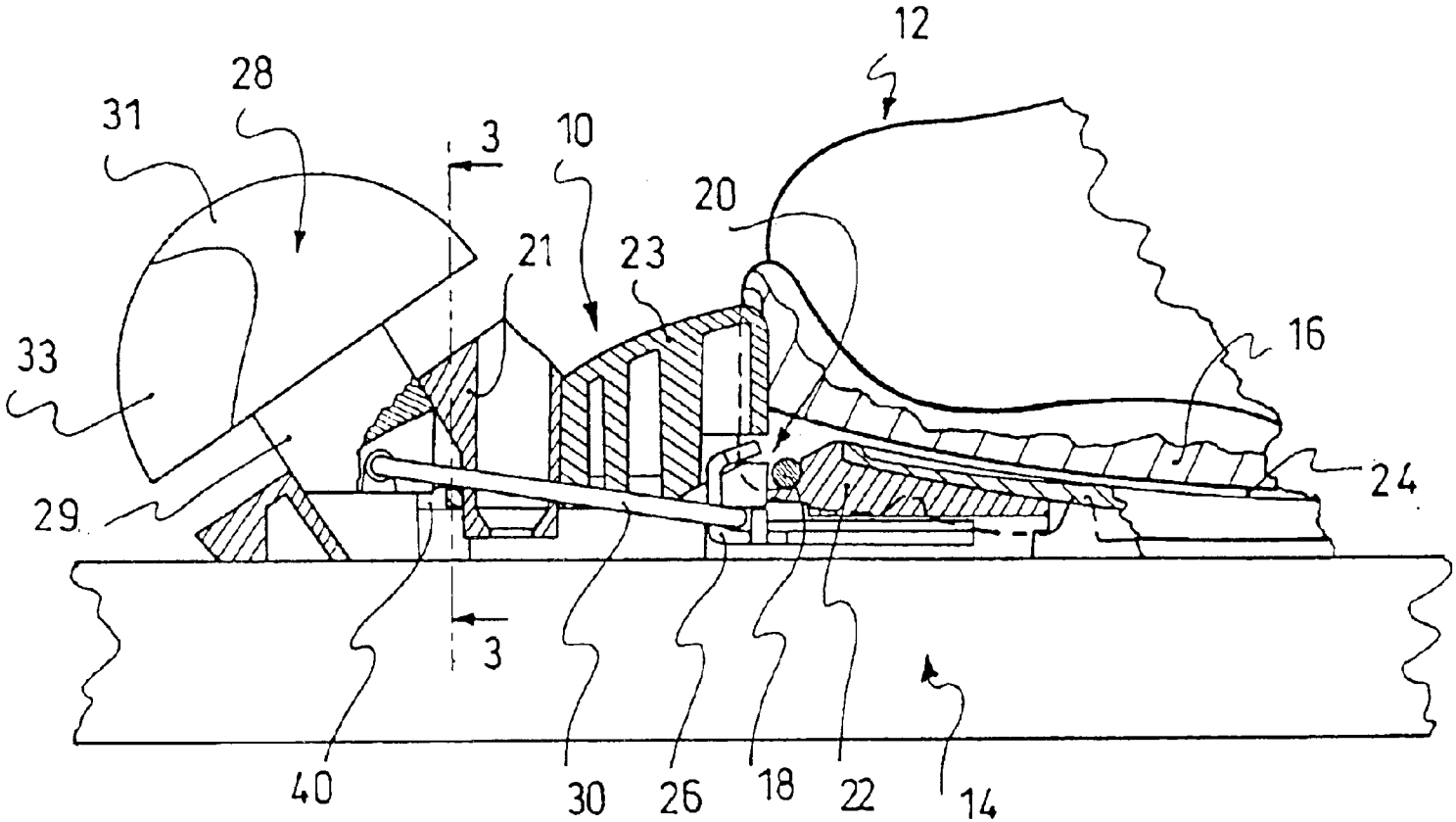
FIG. 1 is a schematic longitudinal cross-sectional view of a binding device according to the teachings of the invention, shown in the open position.
Figure 2:
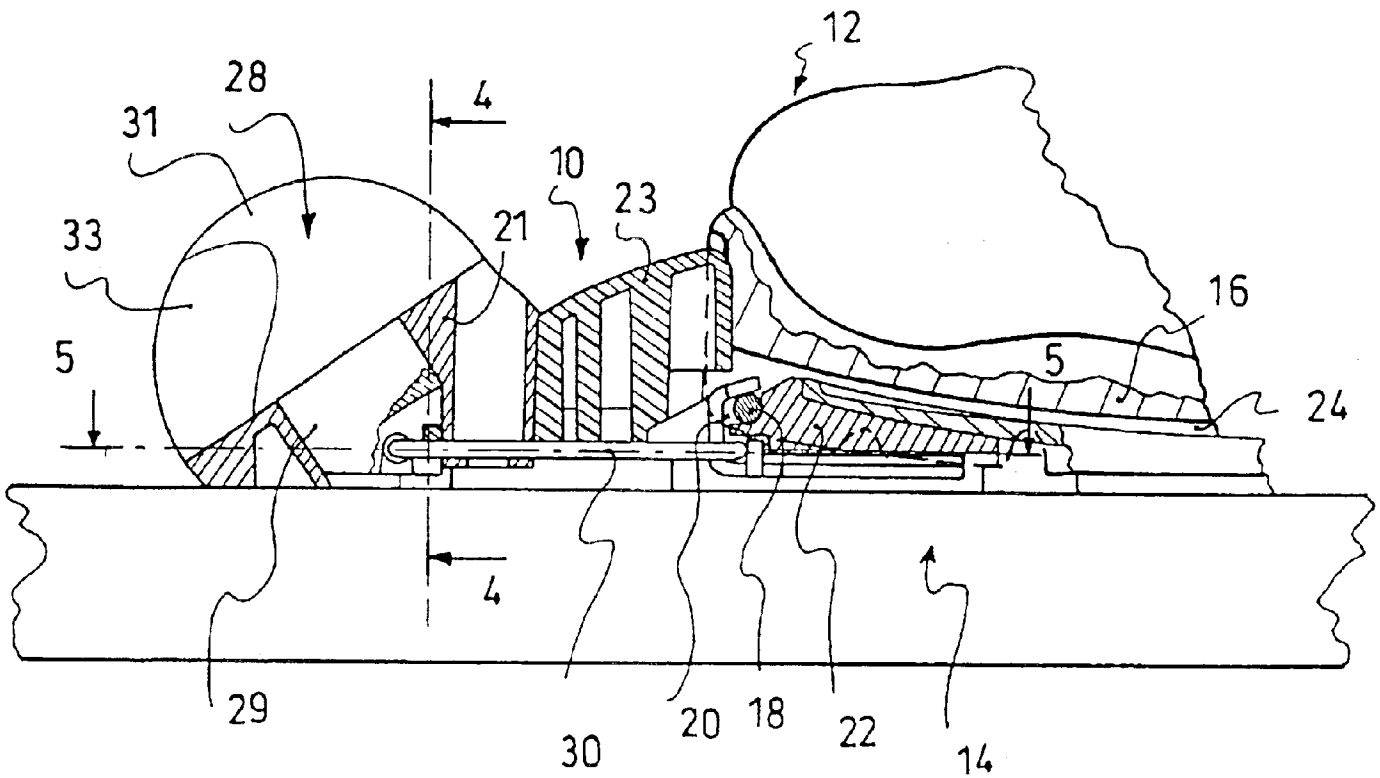
FIG. 2 is a view similar to that of FIG. 1 in which the device is shown in the closed position.

FIGS. 1–5 show a device 10 for binding a boot 12 to a cross-country ski 14. As mentioned above, however, the invention encompasses the application of binding the front of a boot to other sports article(s). In the embodiment shown, the device 10 is attached to an upper surface of the ski 14. The geometric references of top, bottom, front, rear, etc., relate to the arrangement of the disclosed structure in normal use as shown in the drawings, and the corresponding terms used hereinbelow are not to be considered as being restrictive to the scope of the invention.

The boot 12 has, at the front end of its sole 16, a transverse fastening rod 18. This rod/pin 18 is cylindrical and, when it is kept enclosed in a corresponding housing 20 demarcated in a fixed body 21 of the device 10, it is adapted to form an articulation axis of the boot on the ski 14, which in particular allows the boot heel to be raised from the ski. In a known manner, this housing 20 is arranged in front of a guide structure incorporated with the device 10, this guide structure having, for example, at least one ridge/rib 22. The rib 22 extends so as to protrude with respect to the ski 14, longitudinally toward the rear, and the sole 16 of the boot has a complementarily shaped groove 24 that is open downwardly in order to straddle the rib 22 and to participate in the transverse guiding of the boot with respect to the ski 14. The binding device 10 shown in the drawing figures also has an elastic buffer/cushion 23 that is affixed to the fixed body 21 and that is adapted to cooperate with an abutment surface formed at the front of the sole 16 of the boot 12.

The rod 18 extends across the groove 24, at the front end thereof. The housing 20 is open transversely on both sides, and it is also open upwardly to allow the engagement of the rod 18 from the top downwardly into the housing 20. It is adapted to be closed toward the top by a latch 26 that is movable between an open position shown in FIG. 1 and a closed position shown in FIG. 2. In the closed position of the latch 26, the rod 18 can no longer exit from the housing 20, which ensures a reliable binding of the boot 12 to the ski 14. In the example shown, the latch 26 slides longitudinally (in a horizontal plane) from the front rearwardly, from its open position to its closed position. In order to control the displacement of the latch 26, the binding device 10 has a control system allowing a comfortable handling by the user.

According to the invention, the control system essentially has a gripping member 28 that is slidably movable (i.e., in translation) with respect to the fixed body 21, and a connecting rod/member 30 that is linked by its two ends to the latch 26, on the one hand, and to the gripping member 28, on the other hand. In the present case, the gripping member slides along a direction neither parallel to nor co-extensive with the direction of displacement of the latch 26 (i.e., the direction of movement of the gripping member is not contained within the aforementioned horizontal plane within which the latch moves), and the connecting member 30 is linked to the latch 26 and to the gripping member 28 through articulations having a transverse axis.

In the example shown, the gripping member 28 is arranged at the front of the binding device 10, and it has the form of a mushroom, the stem 29 of which is movably mounted in the fixed body 21 of the binding device along a sliding direction tilted, upwardly and frontwardly, along an angle on the order of 45 degrees with respect to the horizontal plane. The stem 29 is in the form of a (possibly rotational) cylinder that is guided in an opening with a corresponding cross-section which is formed in the fixed body 21, which can be formed of several elements. The stem 29 is topped, for example, by a semi-sphere 31 provided with holds 33 for an easy grip.

In order to open the housing 20, one must pull the gripping member 28 upwardly and forwardly (in a longitudinal and vertical plane). To close it, one only needs to perform the opposite maneuver, namely push the gripping member 28 downwardly and rearwardly. Thus, by the mere position of the semi-sphere 31, i.e., upwardly away from the ski or downwardly toward the ski, the user and those around him can very easily see if the latch is open or closed.

Figure 5:
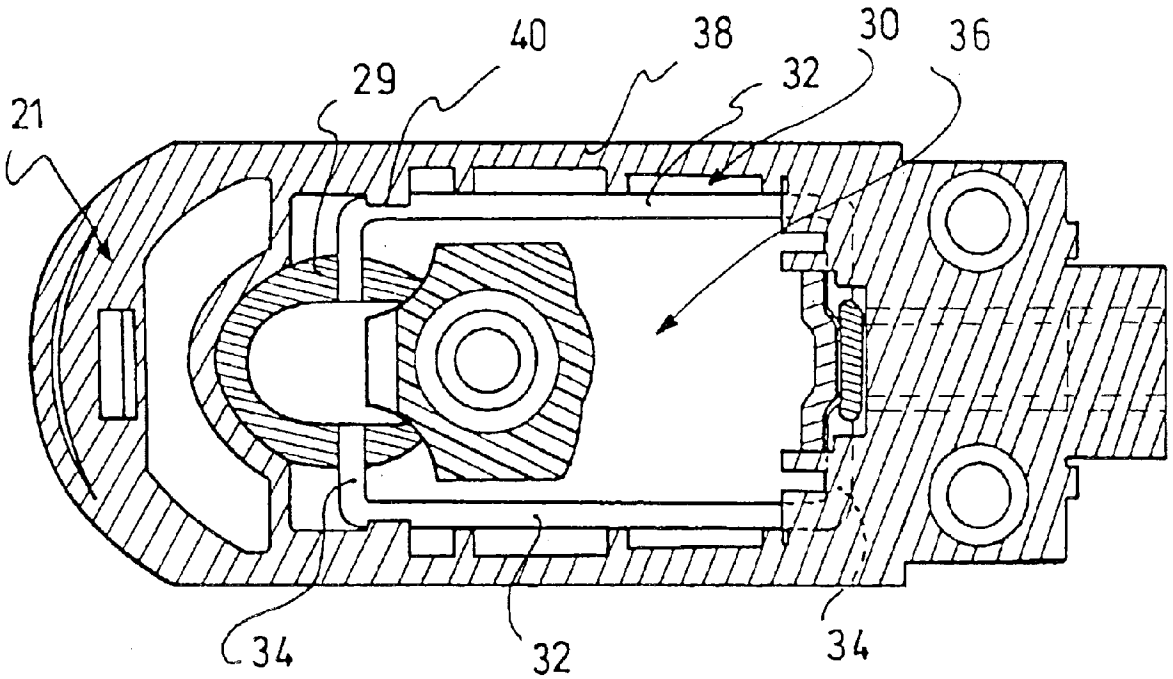
FIG. 5 is a schematic cross-sectional view along the line 5—5 of FIG. 2, showing in more detail an embodiment of the connecting rod.

As can be seen particularly in FIG. 5, the connecting member 30 is in the form of a metal frame with a substantially rectangular contour, having two lateral longitudinal arms 32 and two transverse end arms 34 through which it is articulated on one side on the gripping member, and on the other side on the latch 26. In the closed position of the control system, the connecting member 30 extends substantially in a horizontal plane, in the extension of the sliding direction of the latch 26. In this case, the connecting member 30 extends forwardly with respect to the latch 26, such that it is articulated by its rear end on the latch 26, and by its front end on the stem 29 of the gripping member. In the open position, the front end of the connecting member 30 is raised with respect to its rear end. Indeed, whereas the rear end of the connecting member is displaced only along the horizontal direction, like the latch, the front end of the connecting member is displaced along a trajectory that has a horizontal component and a vertical component. This results from the tilting of the sliding direction of the gripping member. The connecting member 30, particularly its longitudinal arms 32, is sized to be able to work in traction (during opening) as well as in compression (during closing).

According to another aspect of the invention, a structural arrangement is provided to ensure that the latch is either in the open position or in the closed position, and not in an intermediate position. In the example shown, this structural arrangement is constituted of elements that do not allow the control system to occupy more than two stable positions, the two open and closed positions corresponding to the open and closed positions of the latch 26.

Figure 4:
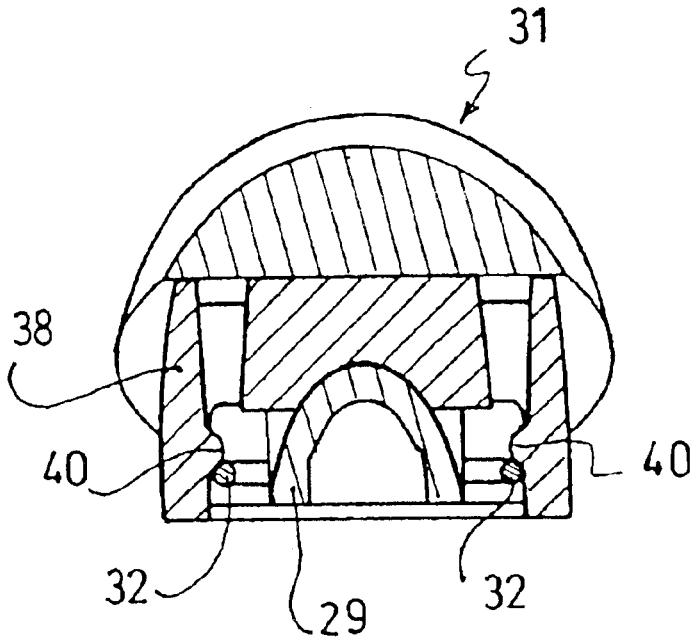
FIGS. 3 and 4 are schematic cross-sectional views along the lines 3—3 and 4—4 of FIGS. 1 and 2, showing in more detail the locking arrangement of the control system in the open position and in the closed position.
Figure 3:
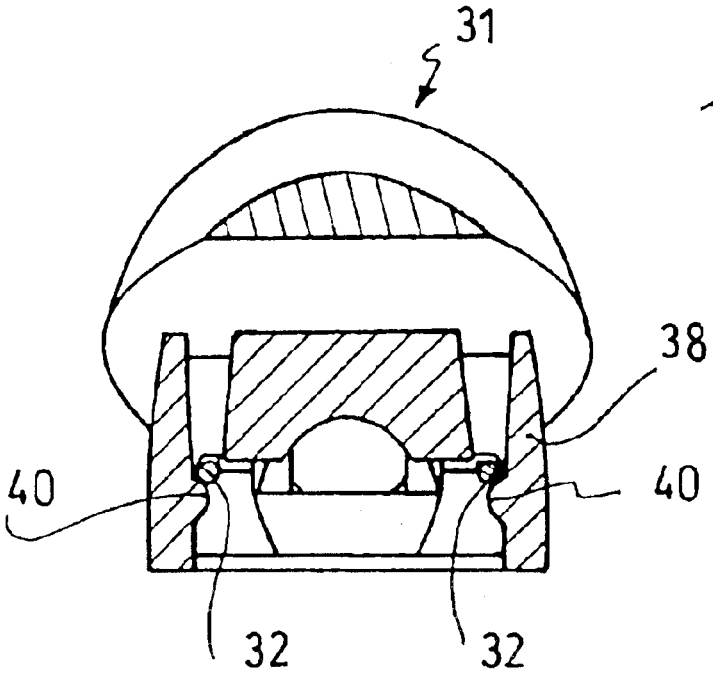

As can be seen, for example, in FIG. 5, the connecting member 30 extends in a compartment 36 demarcated within the fixed body 21. This compartment 36 is particularly demarcated transversely by two outer longitudinal partitions 38, along which the two longitudinal arms 32 of the connecting member 30 are displaced when one handles the control system between its open position and its closed position. Each of these outer partitions 38 has a lug 40 that extends transversely inwardly so as to be positioned across the vertical component of the trajectory of the connecting member 30. These lugs 40 are arranged so as to cooperate with the front end of the connecting member 30. As can be seen in FIGS. 3 and 4, the upper and lower edges of the lugs 40 are beveled. When the system is maneuvered, the connecting member 30 passes over or under the lugs 40 through the elastic deformation of the longitudinal arms 32 that, due to the shapes of the lugs, cannot remain balanced on the lugs. Thus, the longitudinal arms 32 necessarily tilt on one or the other side of these lugs, thus bringing the latch either towards its open position or towards its closed position. This system could also function with a single lug.

Other means can be provided for ensuring the locking of the control system in one or the other of its open or closed positions, or, as described hereinabove, in one or the other of its positions.

What is claimed is:

1. A device for binding a boot to a sports article, said device comprising:

a housing adapted to receive a fastening member for fastening the boot to the device;

a movable latch arranged to be displaced between an open position, in which the fastening member can be introduced or disengaged from the housing, and a closed position, in which the latch prevents the disengagement of the fastening member; and a control system for controlling displacement of the movable latch, the control system comprising a gripping member and a connecting rod, the connecting rod having two ends, a first of the two ends being linked to the movable latch and a second of the two ends being linked to the gripping member;

the gripping member being slidably movable in a linear direction not contained in a horizontal plane defined by a lowermost surface of the device adapted to be supported upon the sports article.

2. A device according to claim 1, wherein the gripping member, the connecting rod, and the latch are movably mounted in a fixed body of the binding device.

3. A device according to claim 1, wherein the latch is slidably movable.

4. A device according to claim 1, wherein the gripping member slides along a direction not parallel to the displacement direction of the latch.

5. A device according to claim 1, wherein the first of the two ends of the connecting rod is articulated to the movable latch and the second of the two ends of the connecting rod is articulated to the gripping member.

6. A device according to claim 5, wherein the connecting rod is articulated on the latch and on the gripping member about two respective transverse axes, each of said axes being perpendicular to a plane defined by the two sliding directions of the latch and of the gripping member.

7. A device according to claim 1, wherein the control system comprises a structural arrangement for locking the latch selectively in the closed position and/or in the open position.

8. A device according to claim 1, wherein the connecting rod comprises two parallel longitudinal arms, said arms being articulated on the latch and on the gripping member.

9. A device according to claim 1, wherein the device is a cross-country ski binding, the sports article being a cross-country ski, and wherein the housing is defined by structure that comprises means for allowing the boot to pivot about the fastening member while latched within the housing.

10. A device according to claim 1, wherein the device is a cross-country ski binding, the sports article being a cross-country ski, and wherein the device comprises no structure that would prevent the boot from pivoting about the fastening member while latched within the housing.

11. A device according to claim 1, wherein the direction of the slidable movement of the gripping member is forward and upward.

12. A device for binding a boot to a sports article, said device comprising:

a housing adapted to receive a member for fastening the boot;

a movable latch arranged to be displaced between an open position, in which the fastening member can be introduced or disengaged from the housing, and a closed position, in which the latch prevents the disengagement of the fastening member;

a control system for controlling displacement of the movable latch, the control system comprising a slidably movable gripping member and a connecting rod, the connecting rod having two ends, a first of the two ends linked to the movable latch and a second of the two ends being linked to the gripping member;

the connecting rod comprising two substantially parallel longitudinal arms, said arms being articulated on the latch and on the gripping member;

at least one transverse lug projecting with respect to a path of one of the two arms of the connecting rod as said one of the two arms moves between the open and closed positions, such that the connecting rod is elastically deformed to pass over an obstacle formed by the lug, wherein the open and closed positions are determined by a support of the arm on either of two sides of the lug.

13. A device for binding a boot to a sports article, said device comprising:

a housing adapted to receive and house a fastening member of a boot while the boot is supported upon the sports article;

a structural arrangement for selectively placing the housing in an open state and in a closed state, selectively;

in said open state, the housing being open to receive and house the fastening member of the boot in said open state;

in said closed state, the housing being closed to prevent removal of the fastening member of the boot in the closed state, the structural arrangement comprising a member for blocking the fastening member of the boot against withdrawal from the housing in the closed state;

said structural arrangement further comprising:

a gripping member adapted to be engaged and moved by a user; and a guide to guide the gripping member in a sliding movement to place the gripping member selectively in one of at least two different positions, each of the two positions being spaced from the sports article by a different respective distance when the device is mounted upon the sports article, in a first of the two positions the housing being in the open state and in a second of the two positions the housing being in the closed state.

14. A device according to claim 13, wherein:

the guide extends in a direction upwardly and frontwardly of the device and with respect to the sports article when the device is mounted upon the sports article.

15. A device according to claim 13, wherein:

the guide extends along a direction to permit movement of said gripping member between the two positions only along a straight path.

16. A device according to claim 15, wherein:

said straight path lies within a longitudinal and vertical plane.

17. A device according to claim 16, wherein:

said straight path extends forwardly and upwardly.

18. A device according to claim 15, wherein:

the member for blocking the fastening member against withdrawal from the housing in the closed state of the housing comprises a latch, the latch being operatively connected to the gripping member;

in the first of the two positions of the gripping member the latch is in a blocking position to block the fastening member of the boot against withdrawal from the housing;

in the second of the two positions of the gripping member the latch is in a withdrawn position to allow the fastening member of the boot to be withdrawn from the housing.

19. A device according to claim 18, wherein:

the structural arrangement, including at least the gripping member, the guide, and the latch, are mounted in a fixed body of the binding device.

20. A device according to claim 18, wherein:

the structural arrangement further comprises a connecting member, the connecting member having two ends, a first of the two ends being linked to the latch and a second of the two ends being linked to the gripping member.

21. A device according to claim 20, wherein:

the structural arrangement, including at least the gripping member, the guide, the connecting member, and the latch, are mounted in a fixed body of the binding device.

22. A device according to claim 18, wherein:

the structural arrangement further comprises a connecting member, the connecting member having two ends, a first of the two ends being articulated to the latch and a second of the two ends being articulated to the gripping member.

23. A device according to claim 22, wherein:

the connecting rod is articulated on the latch and on the gripping member about two transverse axes, each of which is perpendicular to the plane defined by the two sliding directions of the latch and of the gripping member.

24. A device according to claim 18, wherein:

the connecting member comprises two parallel arms, each of the arms being articulated both to the latch and to the gripping member.

25. A device according to claim 18, wherein:

the latch is slidably movable.

26. A device according to claim 25, wherein:

the gripping member is slidable along a direction not parallel to a direction of movement of the latch.

27. A device according to claim 18, further comprising:

a structural arrangement for locking the latch in at least one of the closed and open states of the housing.

28. A device according to claim 18, wherein:

the device is a cross-country ski binding, the sports article being a cross-country ski;

the housing is defined by structure that comprises means for allowing the boot to pivot about the fastening member while latched within the housing.

29. A device according to claim 18, wherein:

the device is a cross-country ski binding, the sports article being a cross-country ski;

the device comprises no structure that would prevent the boot from pivoting about the fastening member while latched within the housing.

30. A device for binding a boot to a sports article, said device comprising:

a housing adapted to receive and house a fastening member of a boot while the boot is supported upon the sports article;

a structural arrangement for selectively placing the housing in an open state and in a closed state, selectively;

in said open state, the housing being open to receive and house the fastening member of the boot in said open state;

in said closed state, the housing being closed to prevent removal of the fastening member of the boot in the closed state, the structural arrangement comprising a member for blocking the fastening member of the boot against withdrawal from the housing in the closed state;

said structural arrangement further comprising:

a gripping member adapted to be engaged and moved by a user; and a guide to guide the gripping member in a sliding movement to place the gripping member selectively in one of at least two different positions, each of the two positions being spaced from a plane defined by a lowermost extent of the device by a different respective distance when the device is mounted upon the sports article, in a first of the two positions the housing being in the open state and in a second of the two positions the housing being in the closed state.

* * * * *